US011456552B2

(12) United States Patent
Minamino et al.

(10) Patent No.: US 11,456,552 B2
(45) Date of Patent: Sep. 27, 2022

(54) CONNECTOR AND CONNECTOR DEVICE

(71) Applicant: Yazaki Corporation, Tokyo (JP)

(72) Inventors: Yuya Minamino, Shizuoka (JP); Takashi Sone, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/326,464

(22) Filed: May 21, 2021

(65) Prior Publication Data

US 2021/0384665 A1 Dec. 9, 2021

(30) Foreign Application Priority Data

Jun. 3, 2020 (JP) ..... JP2020-096590

(51) Int. Cl.

| | |
|---|---|
| ***H01R 13/42*** | (2006.01) |
| ***H01R 13/502*** | (2006.01) |
| ***H01R 13/629*** | (2006.01) |
| ***H01R 13/05*** | (2006.01) |
| ***H01R 13/24*** | (2006.01) |
| ***H01R 13/11*** | (2006.01) |
| ***H01R 13/516*** | (2006.01) |

(52) U.S. Cl.

CPC ..... *H01R 13/42* (2013.01); *H01R 13/05* (2013.01); *H01R 13/11* (2013.01); *H01R 13/2407* (2013.01); *H01R 13/502* (2013.01); *H01R 13/516* (2013.01); *H01R 13/629* (2013.01)

(58) Field of Classification Search

CPC .... H01R 13/443; H01R 13/648; H01R 13/42; H01R 13/05; H01R 13/11; H01R 13/2407; H01R 13/502; H01R 13/516; H01R 13/629; H01R 13/447; H01R 13/114; H01R 13/44; H01R 24/00

See application file for complete search history.

(56) References Cited

U.S. PATENT DOCUMENTS

| | | | | |
|---|---|---|---|---|
| 5,711,686 | A * | 1/1998 | O'Sullivan ..... | H01R 13/65918 439/607.41 |
| 7,727,021 | B2 * | 6/2010 | Haruna ..... | H01R 13/6582 439/607.41 |
| 8,056,867 | B2 * | 11/2011 | Tan Chin Yaw ..... | H01R 13/631 248/51 |
| 10,027,054 | B2 * | 7/2018 | Takeshita ..... | H01R 43/18 |
| 10,418,743 | B2 * | 9/2019 | Mori ..... | H01R 13/5812 |

(Continued)

FOREIGN PATENT DOCUMENTS

| | | |
|---|---|---|
| JP | 2016-143569 A | 8/2016 |
| JP | 2016-146282 A | 8/2016 |

(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A cover has both ends in an extension direction being connected to an insulating member body. A dividing portion formed in a part of the extension direction divides the cover into a first section and a second section. The first section and the second section come into contact with a spring contact when a male terminal contact portion is inserted between a pair of female terminal contact portions. On contact with the spring contact, the first section and the second section elastically deform at least in an opposing direction.

3 Claims, 9 Drawing Sheets

(56) References Cited

U.S. PATENT DOCUMENTS

| | | | | |
|---|---|---|---|---|
| 10,498,077 | B2 | 12/2019 | Ohsako | |
| 2009/0258521 | A1* | 10/2009 | Ooki | H01R 13/521 439/275 |
| 2015/0288101 | A1* | 10/2015 | Matsunaga | H01R 13/4538 439/378 |
| 2016/0036155 | A1* | 2/2016 | Kataoka | H01R 13/405 439/736 |
| 2016/0111809 | A1* | 4/2016 | Kataoka | H01R 13/5205 439/587 |
| 2016/0134049 | A1* | 5/2016 | Kataoka | H01R 13/6581 439/587 |
| 2019/0190185 | A1 | 6/2019 | Mori | |
| 2019/0190192 | A1* | 6/2019 | Mori | H01R 13/621 |
| 2019/0190211 | A1* | 6/2019 | Yamanashi | H01R 13/6592 |
| 2019/0363479 | A1* | 11/2019 | Yamanashi | H01R 13/5205 |

FOREIGN PATENT DOCUMENTS

| | | | |
|---|---|---|---|
| JP | 2019-110075 | A | 7/2019 |
| JP | 2019-110086 | A | 7/2019 |

* cited by examiner

CONNECTOR AND CONNECTOR DEVICE

CROSS-REFERENCE TO RELATED APPLICATION(S)

The present application claims priority to and incorporates by reference the entire contents of Japanese Patent Application No. 2020-096590 filed in Japan on Jun. 3, 2020.

BACKGROUND OF THE INVENTION

1. Field of the Invention

The present invention relates to a connector and a connector device.

2. Description of the Related Art

A connector device includes a female connector and a male connector. The female connector is provided with a female terminal including a pair of female terminal contact portions opposing each other in an opposing direction. The male connector is provided with a male terminal contact portion which is inserted between the pair of female terminal contact portions.

The male connector includes an insulating member having an insulating property. The insulating member includes an insulating member body, a pair of insertion openings corresponding to the female terminal contact portions and formed in the insulating member body, and a cover formed between the pair of insertion openings and opposes the male terminal contact portion in an insertion direction. Due to the cover, the male terminal contact portion is prevented from being exposed to the outside (see, for example, Japanese Patent Application Laid-open No. 2019-110086).

The female connector may include a spring contact in the female terminal contact portions. When such a female connector is employed in the above connector device, the spring contact comes into contact with the cover before connecting to the male terminal contact portion. Compared with a case where the spring contact comes into contact only with the male terminal contact portion, the male connector provided with the cover increases an insertion force when the female terminal contact portions are inserted into the insertion openings. For this reason, the male connector has room for improvement in insertion force at the time of inserting the female terminal contact portions into the insertion openings.

SUMMARY OF THE INVENTION

The present invention has been made in light of the problem, and an object of the present invention is to provide a connector and a connector device which reduces an insertion force when female terminal contact portions are inserted into insertion openings while preventing a male terminal contact portion placed in a storage space from being exposed to the outside.

A connector according to one aspect of the present invention includes a male terminal including a male terminal contact portion inserted between a pair of female terminal contact portions opposing each other in an opposing direction; an insulating member having an insulating property, including a storage space which stores at least the male terminal contact portion and allows the pair of female terminal contact portions to be inserted from the outside; and a housing configured to store the insulating member, wherein the pair of female terminal contact portions is formed with a pair of opposing surfaces opposing each other in the opposing direction across the male terminal contact portion, the pair of opposing surfaces is formed with a plurality of spring contacts elastically deformable in an extraction direction which is an opposite direction of an insertion direction in which the male terminal contact portion is inserted between the pair of female terminal contact portions, the plurality of spring contacts being formed in an extension direction perpendicular to the insertion direction, the insulating member includes an insulating member body included in the storage space, a pair of insertion openings configured to communicate with the storage space and formed in the insulating member body, corresponding to the pair of female terminal contact portions, and a cover formed between the pair of insertion openings and opposing the male terminal contact portion in the insertion direction, the cover has both ends in the extension direction connected to the insulating member body, the cover is divided into a first section and a second section by a dividing portion formed in a part of the extension direction, and the first section and the second section are configured to come into contact with the plurality of spring contacts when the male terminal contact portion is inserted between the pair of female terminal contact portions, the first section and the second section being elastically deformable at least in the opposing direction on contact with the plurality of spring contacts.

According to another aspect of the present invention, in the connector, it is preferable that the first section includes a protrusion protruding toward the second section at a first section end which is an end facing toward the second section in the extension direction, and the second section includes a recess recessed toward the second section at a second section end which is an end facing toward the first section in the extension direction, the protrusion and the recess being configured to come into contact with each other when one of the first section and the second section elastically deforms with respect to the other in the opposing direction.

A connector device according to still another aspect of the present invention includes a counterpart connector; and a connector configured to fit into the counterpart connector, the counterpart connector including a counterpart terminal including a pair of female terminal contact portions opposing each other in an opposing direction, and a counterpart housing configured to store the counterpart terminal, and the connector including a male terminal including a male terminal contact portion inserted between the pair of female terminal contact portions, an insulating member having an insulating property, including a storage space which stores at least the male terminal contact portion and allows the pair of female terminal contact portions to be inserted from the outside, and a housing configured to store the insulating member, wherein the pair of female terminal contact portions is formed with a pair of opposing surfaces opposing each other in the opposing direction across the male terminal contact portion, the pair of opposing surfaces is formed with a plurality of spring contacts elastically deformable in an extraction direction which is the opposite direction of an insertion direction in which the male terminal contact portion is inserted between the pair of female terminal contact portions, the plurality of spring contacts being formed in an extension direction perpendicular to the insertion direction, the insulating member includes an insulating member body included in the storage space, a pair of insertion openings configured to communicate with the storage space and formed in the insulating member body, corresponding to the pair of female terminal contact portions, and a cover formed between the pair of insertion openings and opposing the male terminal contact portion in the insertion direction, the cover has both ends in the extension direction connected to the insulating member body, the cover is divided into a first section and a second section by a dividing portion formed in a part of the extension direction, and the first section and the second section are configured to come into contact with the plurality of spring contacts when the male terminal contact portion is inserted between the pair of female terminal contact portions, the first section and the second section being elastically deformable at least in the opposing direction on contact with the plurality of spring contacts.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
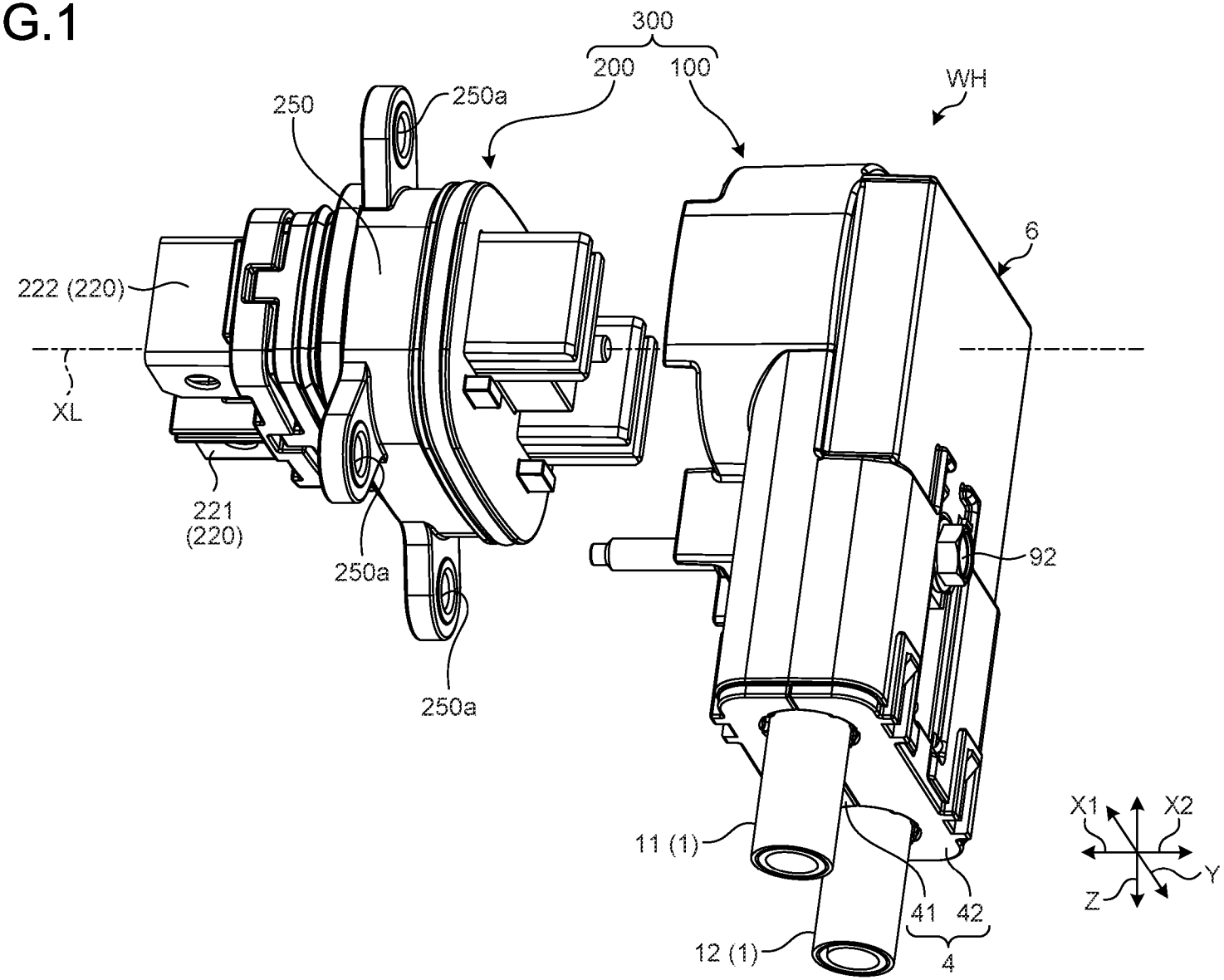
FIG. 1 is a perspective view of a connector device including a connector and a counterpart connector according to this embodiment.
Figure 2:
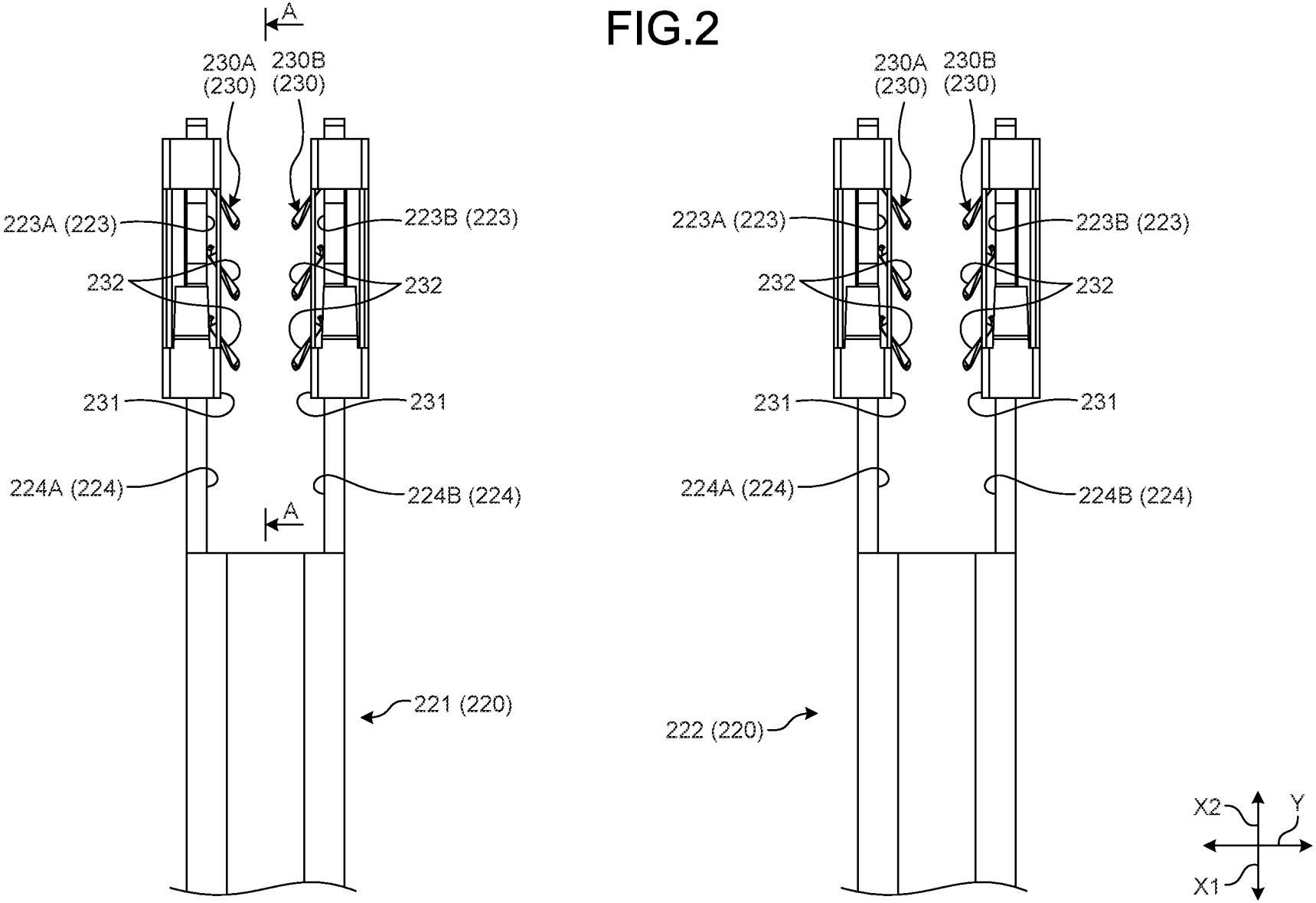
FIG. 2 is a plan view of female terminal contact portions of the counterpart connector.
Figure 3:
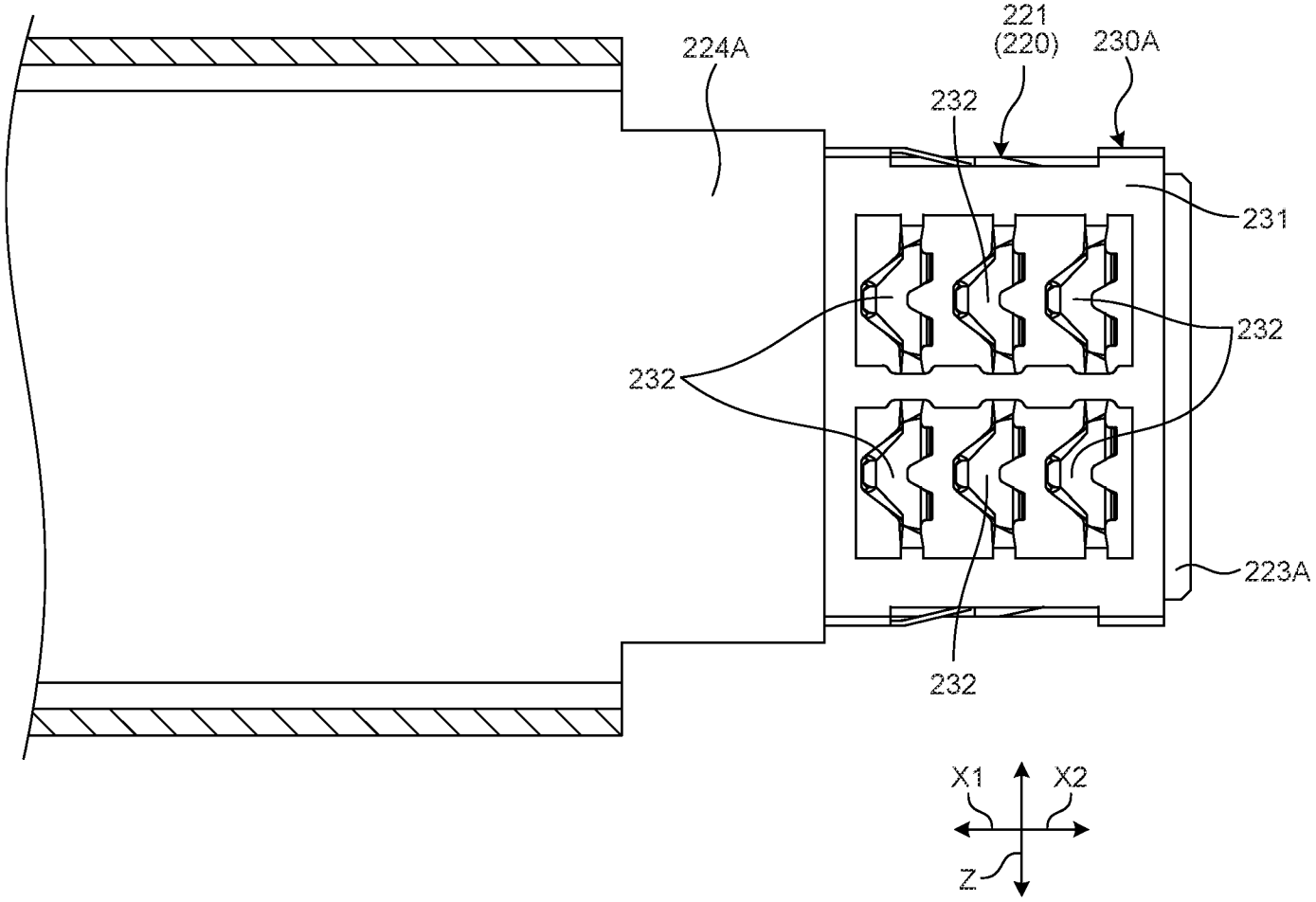
FIG. 3 is a cross-sectional view taken along line A-A in FIG. 2.
Figure 4:
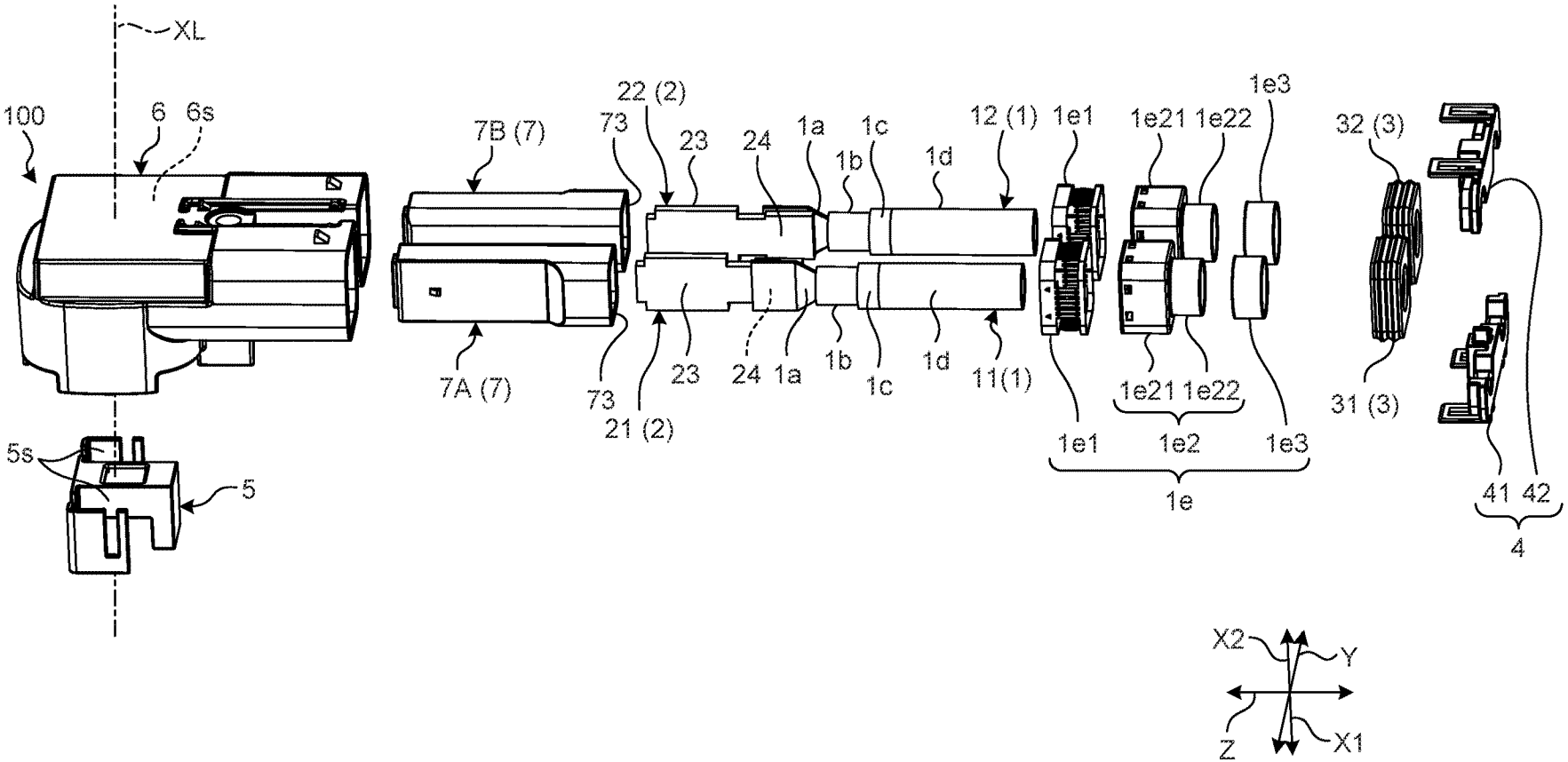
FIG. 4 is an exploded perspective view of the connector according to this embodiment.
Figure 5:
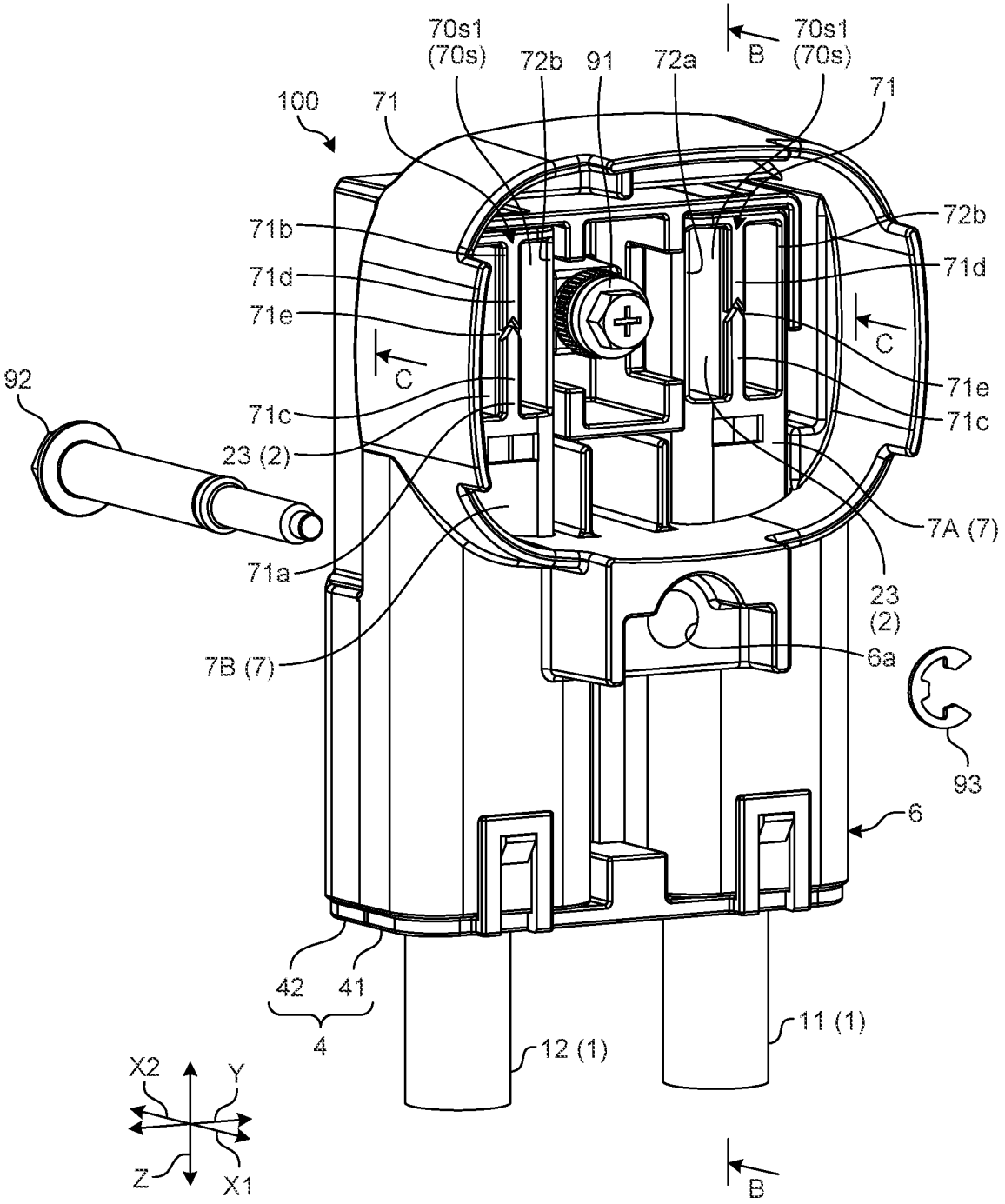
FIG. 5 is a perspective view of the connector according to this embodiment.
Figure 6:
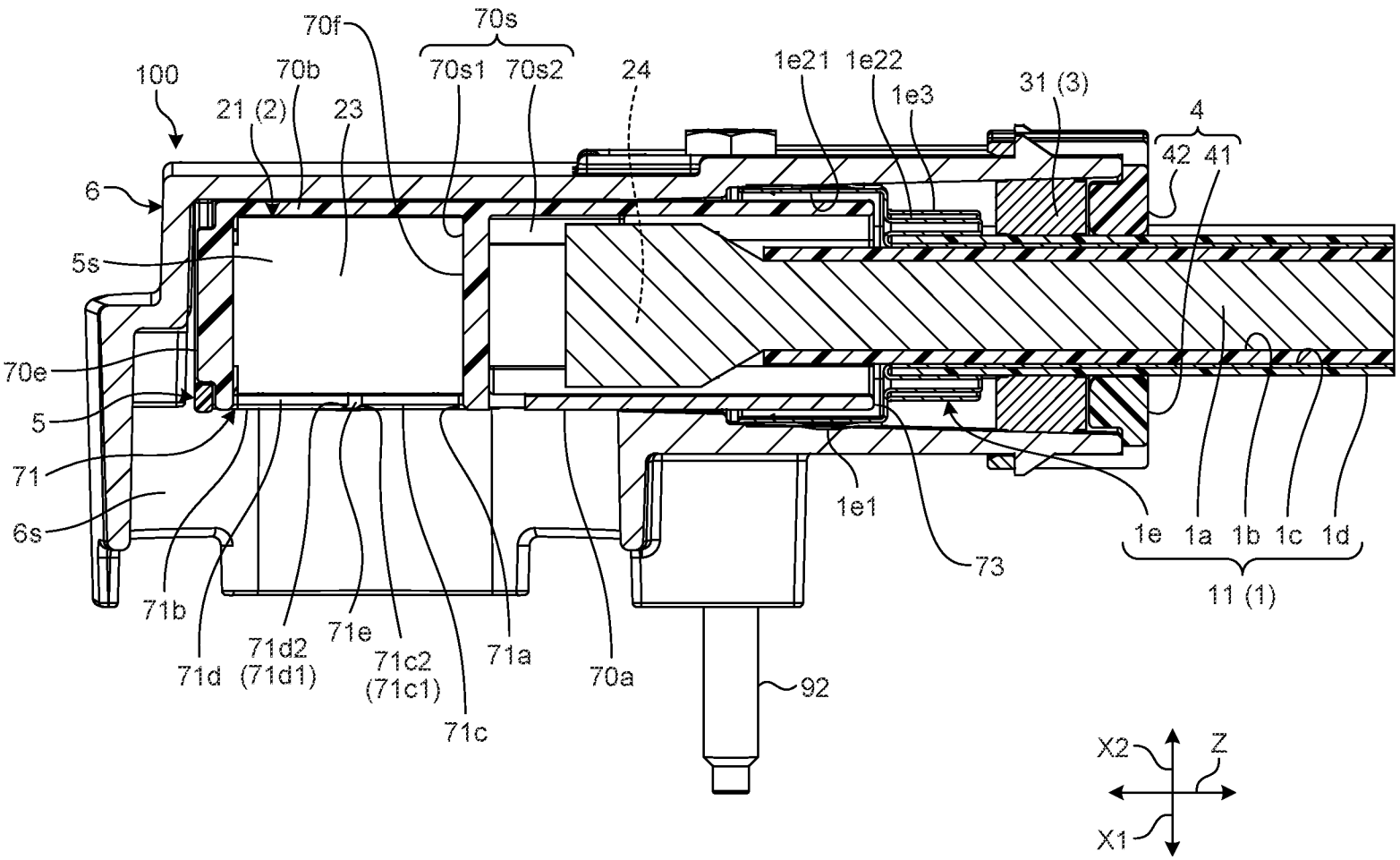
FIG. 6 is a cross-sectional view taken along line B-B in FIG. 5.
Figure 7:
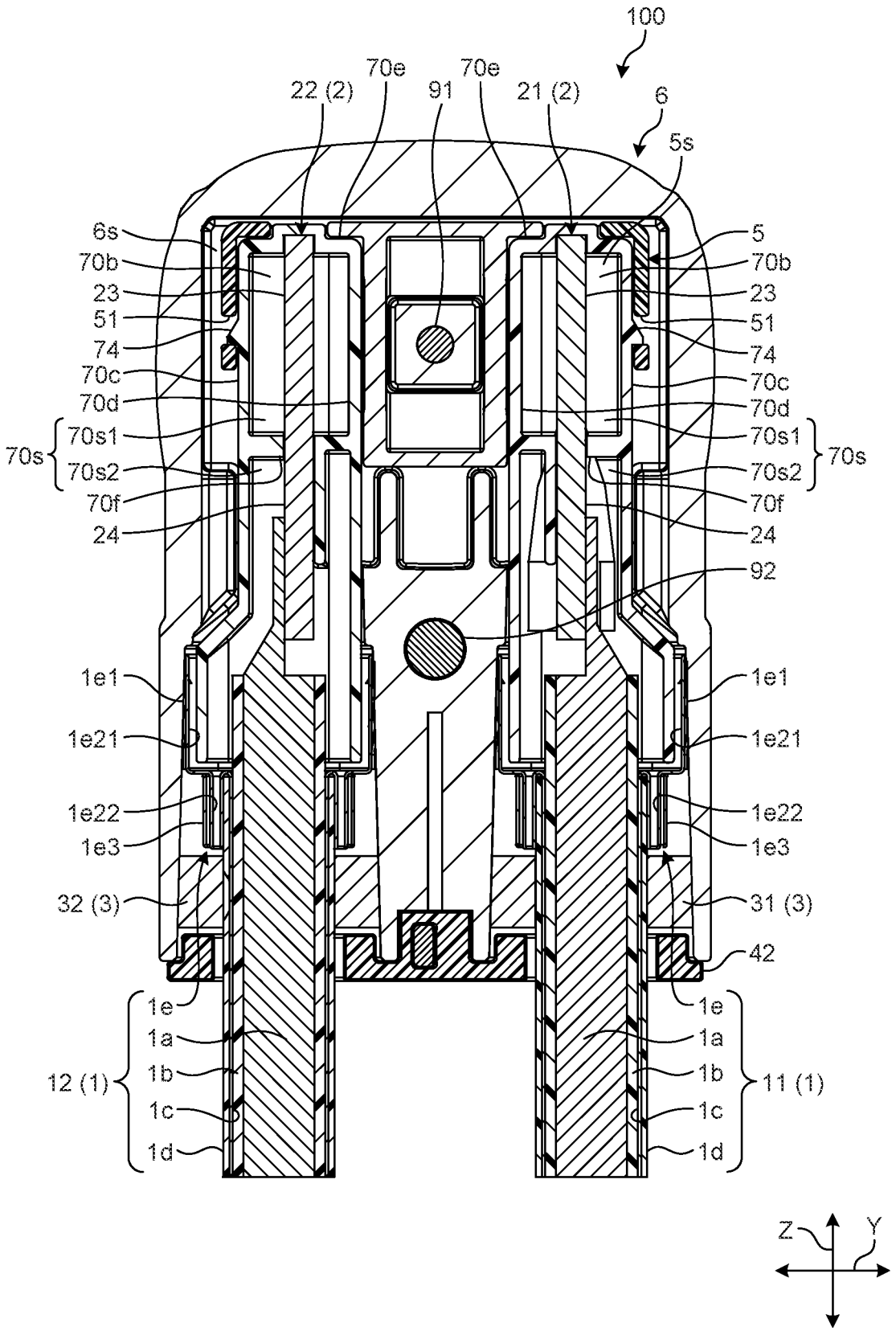
FIG. 7 is a cross-sectional view taken along line C-C in FIG. 5.
Figure 8:
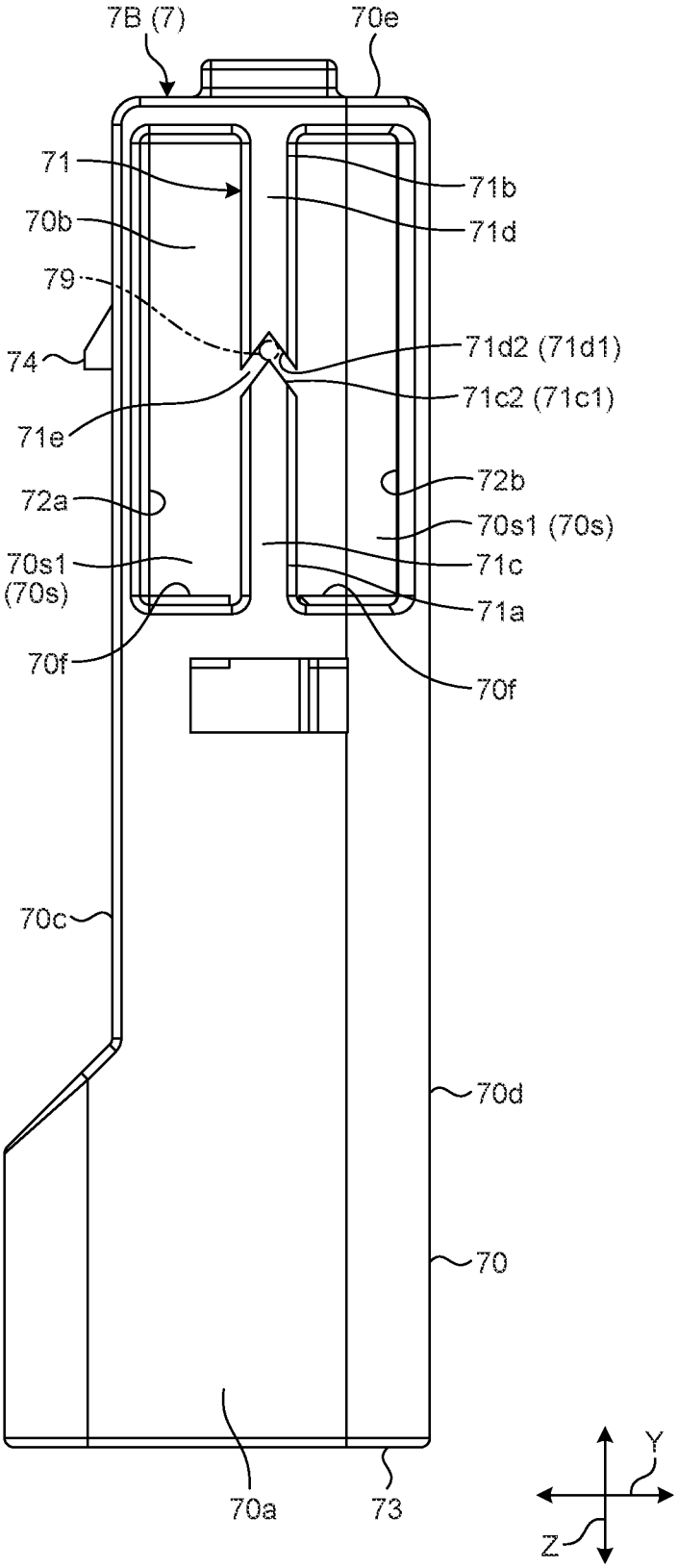
FIG. 8 is a front view of an insulating member 7 included in the connector according to this embodiment.
Figure 9:
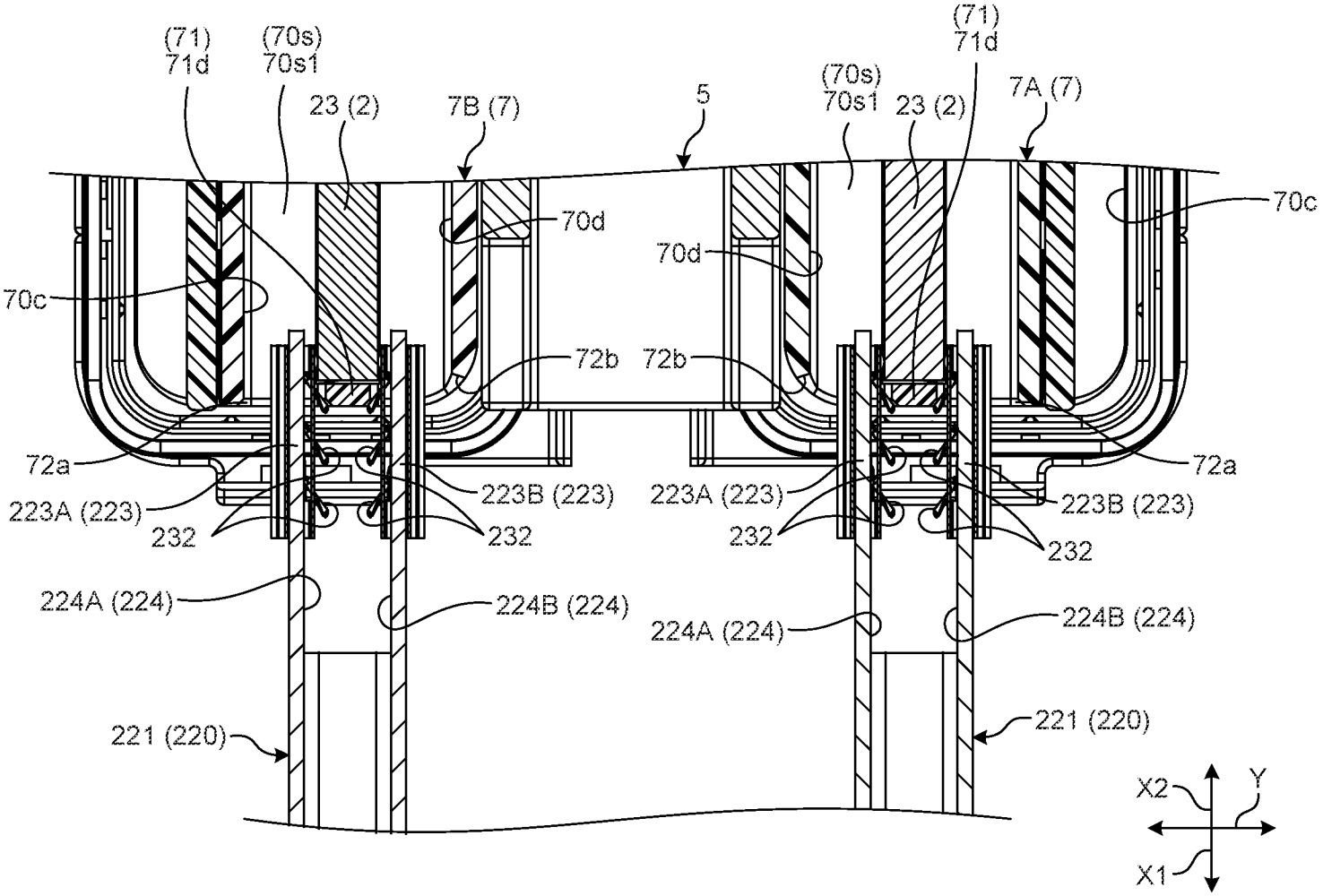
FIG. 9 is a cross-sectional view when the female terminal contact portions are inserted into insertion openings 72*a* and 72*b* of the connector according to this embodiment.

FIG. 1 is a perspective view of a connector device 300 including a connector 100 and a counterpart connector 200 according to this embodiment. FIG. 2 is a plan view of female terminal contact portions 223A and 223B of the counterpart connector 200. FIG. 3 is a cross-sectional view taken along line A-A in FIG. 2. FIG. 4 is an exploded perspective view of the connector 100 according to this embodiment. FIG. 5 is a perspective view of the connector 100 according to this embodiment. FIG. 6 is a cross-sectional view taken along line B-B in FIG. 5. FIG. 7 is a cross-sectional view taken along line C-C in FIG. 5. FIG. 8 is a front view of an insulating member 7 included in the connector 100 according to this embodiment. FIG. 9 is a cross-sectional view when the female terminal contact portions 223A and 223B are inserted through insertion openings 72*a* and 72*b* of the connector 100 according to this embodiment.

As illustrated in FIGS. 1 to 9, X1 direction is an insertion direction X1 in which a male terminal contact portion 23 of the connector 100 according to this embodiment is inserted into the female terminal contact portions 223A and 223B of the counterpart connector 200. X2 direction is an extraction direction X2 which is the opposite direction of the insertion direction X1. Y direction is an opposing direction Y in which a pair of female terminal contact portions 223A and 223B opposes each other. Z direction is an extension direction Z perpendicular to the insertion direction X1 of the connector 100. The opposing direction Y of the connector 100 according to this embodiment is perpendicular to the insertion direction X1. Furthermore, the extension direction Z of the connector 100 according to this embodiment is perpendicular to the opposing direction Y.

The connector 100 illustrated in FIG. 1 according to this embodiment is, for example, a shield connector which is applied to a wire harness WH used in a vehicle such as an automobile. The connector 100 according to this embodiment is included in the connector device 300 together with the counterpart connector 200. In order to connect electric devices mounted on a vehicle, for example, the wire harness WH is designed in such a manner that a plurality of electric wires 1 used for power supply or the like is bundled into a collective part and each electric wire 1 is connected to each electric device by the connector 100 or the like. The wire harness WH includes the connector device 300 and the plurality of electric wires 1. In addition, the wire harness WH may further include, for example, a grommet, a protector, an exterior material, and a fixture. The connector 100 according to this embodiment is employed in, for example, the wire harness WH including the electric wires 1 for supplying power from a battery to a motor in a vehicle such as a hybrid vehicle or an electric vehicle.

When the connector 100 is fitted into the counterpart connector 200, a terminal 2 included in the connector 100 is electrically connected to a counterpart terminal 220 included in the counterpart connector 200. In other words, when the terminal 2 of the connector 100 is electrically connected to the counterpart terminal 220 of the counterpart connector 200, the connector 100 serves as a connection mechanism for wire-to-wire connection that electrically connects each electric wire 1 connected to the terminal 2 with each counterpart electric wire connected to the counterpart terminal 220.

The counterpart connector 200 includes the counterpart terminal 220, the counterpart electric wires, and a counterpart housing 250. The counterpart housing 250 stores a pair of counterpart terminals 220 and includes a bolt insertion hole 250*a* through which a bolt is inserted.

Particularly, with regard to the pair of counterpart terminals, the counterpart connector 200 includes the pair of counterpart terminals 220 opposing each other in the opposing direction Y, and the pair of counterpart terminals 220 is symmetric with respect to an axis XL extending along the insertion direction X1 in the opposing direction Y. Hereinafter described is one terminal or a first counterpart terminal 221 of the pair of counterpart terminals 220 illustrated in FIG. 2, and the other terminal or a second counterpart terminal 222 with the details denoted by the same reference numerals will not be described.

The first counterpart terminal 221 is a female terminal formed of a conductive metal and electrically connected to a terminal (male terminal) 2. The first counterpart terminal 221 includes the pair of female terminal contact portions 223A and 223B opposing each other in the opposing direction Y. The first counterpart terminal 221 is electrically connected to an end of each counterpart electric wire. The pair of female terminal contact portions 223A and 223B is formed with a pair of opposing surfaces 224A and 224B opposing each other in the opposing direction Y across the male terminal contact portion 23. The pair of opposing surfaces 224A and 224B is formed with a contact unit 230.

The contact unit 230 is formed of a conductive metal and is disposed on each of the pair of female terminal contact portions 223A and 223B. In other words, the first counterpart terminal 221 has a pair of contact units 230. Particularly, with regard to the contact units 230, the first counterpart terminal 221 includes a first contact unit 230A placed on one side in the opposing direction Y and a second contact unit 230B placed on the other side in the opposing direction Y, and the first contact unit 230A and the second contact unit 230B are symmetric with respect to the opposing direction Y. Hereinafter described is the first contact unit 230A placed on one side in the opposing direction Y, and the second contact unit 230B placed on the other side in the opposing direction Y will not be described.

As illustrated in FIGS. 2 and 3, the first contact unit 230A includes a contact body 231 and a plurality of spring contacts 232. The contact body 231 is formed into a rectangular frame. The plurality of spring contacts 232 is disposed on the inner side of the contact body 231 and disposed on the pair of opposing surfaces 224A and 224B. In each spring contact 232, an end on the side close to the female terminal contact portions 223A and 223B in the insertion direction X1 (that is, the side toward the extraction direction X2) is connected to and supported by the contact body 231 while an end on the side toward the insertion direction X1 is free. Accordingly, each spring contact 232 is supported in a cantilever manner and elastically deformable with respect to the contact body 231 in the insertion direction X1. The plurality of spring contacts 232 having the above configuration is arranged in the insertion direction X1. Moreover, the plurality of spring contacts 232 is arranged in the extension direction Z. That is, in the pair of opposing surfaces 224A and 224B of the counterpart terminal 220 of this example, the plurality of spring contacts 232 elastically deformable in the extraction direction X2 is formed in the extension direction Z.

As illustrated in FIGS. 4, 5, 6, and 7, the connector 100 according to this embodiment is provided with the terminal 2, a packing 3, a rear holder 4, a front holder 5, a housing 6, and an insulating member 7.

The terminal 2 is formed of a conductive metal and is electrically connected to an end of each electric wire 1. The terminal 2 described in this embodiment is a male terminal.

The connector 100 according to this embodiment includes a pair of terminals 2. The pair of terminals 2 is symmetric with respect to the axis XL. Hereinafter described is one terminal or a first terminal 21 of the pair of terminals 2, and the other terminal or a second terminal 22 with the details denoted by the same reference numerals will not be described.

The first terminal 21 is electrically connected to an end of a first electric wire 11. The first terminal 21 is formed of a conductive metal. The first terminal 21 includes a male terminal contact portion 23 and an electric wire connection 24.

The male terminal contact portion 23 comes into contact with the counterpart terminal 220 (see FIG. 2) so as to be electrically connected to the counterpart terminal 220. The male terminal contact portion 23 is placed on one side of the first terminal 21 in the extension direction Z and is arranged in a storage space 70*s* of the insulating member 7 (to be described). Furthermore, the male terminal contact portion 23 is formed into a rectangular flat plate.

The electric wire connection 24 comes into contact with a first core 1*a* of the electric wire 11 so as to be electrically connected to the electric wire 11. The electric wire connection 24 is placed on the other side of the first terminal 21 in the extension direction Z.

The electric wire connection 24 in each terminal 2 is electrically connected to each electric wire 1. More specifically, each of the electric wire connections 24 comes into contact with the first core 1*a* (to be described) of each electric wire 1 so as to be electrically connected to an end of each electric wire 1. The connector 100 of this embodiment includes a plurality of terminals 2. Each terminal 2 is electrically connected to the first core 1*a* placed at the end of each electric wire 1. In this embodiment, two electric wires 1 have the same configuration. Hereinafter described is one electric wire or the first electric wire 11 of the two electric wires 1, and the other electric wire or a second electric wire 12 with the details denoted by the same reference numerals will not be described.

The first electric wire 11 includes the first core 1*a* formed of a conductive metal, an insulating first cover 1*b* that covers the periphery of the first core 1*a*, a braid 1*c* that covers the outer periphery of the first cover 1*b*, a sheath 1*d* that covers the outer periphery of the braid 1*c*, and a connection member 1*e*.

At an end of the first electric wire 11, the first cover 1*b* is removed to expose the first core 1*a*, and the exposed portion of the first core 1*a* is processed into a flat plate shape. The exposed portion of the first core 1*a* is electrically connected to the male terminal contact portion 23.

The braid 1*c* is formed by weaving a conductive metal into a cylindrical shape and by disposing a plating layer of the conductive metal on the surface of the woven metal. Due to the braid 1*c*, noise generated when a high voltage is applied to the first core 1*a* is prevented from leaking to the outside of the first electric wire 11.

The sheath 1*d* is formed into a cylinder by an insulating synthetic resin and covers the outer side of the braid 1*c* in the radial direction so as to protect the braid 1*c*.

The connection member 1*e* is formed of a conductive metal and includes an outer member 1*e*1, an inner member 1*e*$^2$, and a ring-shaped member 1*e*3. The outer member 1*e*1 is formed into a rectangular prism. The outer surface of the outer member 1*e*1 comes into contact with the inner surface of the housing 6 and is electrically connected to the housing 6. The inner member 1*e*2 includes a rectangular prismatic portion 1*e*21 placed on one side in the extension direction Z and a cylindrical portion 1*e*22 placed on the other side in the extension direction Z. The rectangular prismatic portion 1*e*21 is formed into a rectangular prism. The outer surface of the rectangular prismatic portion 1*e*21 comes into contact with the inner surface of the outer member 1*e*1. The cylindrical portion 1*e*22 is formed into a cylinder. The inner periphery of the cylindrical portion 1*e*22 comes into contact with the outer periphery of the braid 1*c*. The ring-shaped member 1*e*3 is formed into a cylinder. While being attached to the outer periphery of the cylindrical portion 1*e*22, the ring-shaped member 1*e*3 is reduced in diameter (swaged) inward in the radial direction with respect to the first core 1*a* so as to electrically connect the braid 1*c* with the cylindrical portion 1*e*22. With such a configuration, the connection member 1*e* electrically connects the braid 1*c* of the first electric wire 11 and the housing 6.

The packing 3 is formed into a rectangular prism by an elastic material such as synthetic rubber and is elastically deformable outward in the radial direction. The connector 100 of this embodiment includes a plurality of packings 3. Each packing 3 is arranged on the outer periphery of each electric wire 1. In this embodiment, two packings 3 have the same configuration. Hereinafter described is one packing or a first packing 31 of the two packings 3, and the description of the other packing or a second packing 32 will be omitted.

The first packing 31 is placed on the outer side of the sheath 1*d* in the radial direction and, for example, prevents foreign matter such as rainwater from entering the interior of the connector 100 from the outer periphery of the sheath 1*d*.

The rear holder 4 is formed of an insulating synthetic resin and attached to the housing 6. In addition, the rear holder 4 holds the plurality of electric wires 1 while being attached to the housing 6. The rear holder 4 includes, for example, a rear first section 41 and a rear second section 42 and is divisible into two in the insertion direction X1. In addition, the rear first section 41 and the rear second section 42 are configured to sandwich the plurality of electric wires 1 therebetween.

The front holder 5 is formed of an insulating synthetic resin and includes a holding space 5*s* for holding the insulating member 7 inside. The front holder 5 includes a front holder recess 51 that holds the insulating member 7. The front holder 5 is attached to the housing 6 and holds a plurality of insulating members 7 (to be described) while being attached to the housing 6.

The housing 6 is what is called a shield shell and is formed of, for example, a conductive metal and includes a housing storage space 6*s* that stores the front holder 5 and the insulating members 7 inside. The housing 6 is formed of a conductive metal. Due to the housing 6, noise generated when a high voltage is applied to the terminals 2 is prevented from leaking to the outside of the housing 6.

The insulating members 7 are formed of an insulating synthetic resin. Each insulating member 7 prevents the male terminal contact portion 23 from coming into contact with the housing 6 so as to prevent an electrical connection between the male terminal contact portion 23 and the housing 6.

The connector 100 of this embodiment includes the plurality of insulating members 7. In the connector 100 of this embodiment, two insulating members 7 are symmetric with respect to the opposing direction Y centering on the axis XL. The description of one insulating member or a first insulating member 7A of the two insulating members 7 will be omitted, and the other insulating member or a second insulating member 7B will hereinafter be described.

As illustrated in FIG. 8, the second insulating member 7B formed of an insulating synthetic resin is provided with an insulating member body 70 included in the storage space 70*s* and provided with a cover 71. The insulating member body 70 includes a front wall 70*a* and a back wall 70*b* opposing each other in the insertion direction X1, a pair of side walls 70*c* and 70*d* opposing each other in the opposing direction Y, and a top wall 70*e* placed on one side in the extension direction Z. These walls are formed into a rectangular prism in an integrated manner, thereby forming the storage space 70*s* inside the insulating member body 70.

The front wall 70*a* and the back wall 70*b* are arranged to have a thickness direction along the insertion direction X1. The both side walls 70*c* and 70*d* are arranged to have a thickness direction along the opposing direction Y. The top wall 70*e* is arranged to have a thickness direction along the extension direction Z. Among the pair of side walls 70*c* and 70*d*, the side wall 70*c* arranged on one side in the opposing direction Y includes an insulating member claw 74 protruding outward.

The insulating member body 70 of this embodiment includes a partition wall 70*f* in the storage space 70*s*. The partition wall 70*f* is arranged to have a thickness direction along the extension direction Z. The partition wall 70*f* is disposed in a part of the insulating member 7 in the extension direction Z and divides the storage space 70*s* into a first storage space 70*s*1 placed on one side of the storage space 70*s* in the extension direction Z and a second storage space 70*s*2 placed on the other side in the extension direction Z.

The front wall 70*a* includes a pair of insertion openings 72*a* and 72*b* that allows the outside to communicate with the first storage space 70*s*1. The female terminal contact portions 223A and 223B are inserted into the pair of insertion openings 72*a* and 72*b* when the connector 100 and the counterpart connector 200 are fitted into each other. That is, the insulating member 7 includes the pair of insertion openings 72*a* and 72*b* that communicates with the storage space 70*s* and is formed corresponding to the female terminal contact portions 223A and 223B.

The other end of the front wall 70*a* in the extension direction Z, the other end of the back wall 70*b* in the extension direction Z, and the other end of the pair of side walls 70*c* and 70*d* in the extension direction Z form an introduction opening 73 that allows the outside to communicate with the second storage space 70*s*2. The male terminal contact portion 23 and the end of the electric wire 1 are inserted into the introduction opening 73. That is, the insulating member 7 includes the introduction opening 73 that communicates with the storage space 70*s* and allows the electric wire 1 to be inserted therethrough.

The cover 71 extends along the extension direction Z and is formed between insertion openings 72*a* and 72*b*. Furthermore, the cover 71 has both ends 71*a* and 71*b* in the extension direction Z connected to the insulating member body 70 and is divided into a first section 71*c* and a second section 71*d* by a dividing portion 71*e* formed in a part of the cover 71 in the extension direction Z. When the male terminal contact portion 23 is inserted into the first storage space 70*s*1 of the second insulating member 7B, the cover 71 opposes the male terminal contact portion 23 in the insertion direction X1 as illustrated in FIG. 9.

The first section 71*c* includes a protrusion 71*c*2 protruding toward the second section at a first section end 71*cl* which is an end facing toward the second section in the extension direction Z. The protrusion 71*c*2 includes, for example, a pair of inclined surfaces opposing each other in the opposing direction Y, and a central portion of the first section 71*c* in the opposing direction Y protrudes most from the first section end 71*c*1 toward the second section. The pair of inclined surfaces extends linearly and is inclined with respect to the extension direction Z and the opposing direction Y.

The second section 71*d* includes a recess 71*d*2 recessed toward the second section at a second section end 71*d*1 which is an end facing toward the first section in the extension direction Z. The recess 71*d*2 includes, for example, a pair of inclined surfaces opposing each other in the opposing direction Y, and a central portion of the second section 71*d* in the opposing direction Y is recessed most from the second section end 71*d*1 toward the second section. The pair of inclined surfaces extends linearly and is inclined with respect to the extension direction Z and the opposing direction Y.

The dividing portion 71*e* is placed between the first section end 71*c*1 of the first section 71*c* and the second section end 71*d*1 of the second section 71*d* in the extension direction Z. The dividing portion 71*e* according to this embodiment has a size that allows insertion of a probe or an inspection tool 79. More specifically, a central portion of the dividing portion 71*e* in the opposing direction Y has a width in the opposing direction Y and a length in the extension direction Z which allow the insertion of the inspection tool 79.

When viewed from the opposing direction Y, in a plane of the cover 71 of this embodiment perpendicular to the extension direction Z, a tip protruding from the first section end 71*cl* toward the second section and a tip protruding from the second section end 71*d*1 toward the first section overlap.

Hereinafter described is the assembly of the connector 100. First, an operator assembles the terminal 2 on the electric wire 1, and then, places the insulating member 7 on one side in the extension direction Z with respect to the terminal 2.

Next, while fixing the insulating member 7, the operator moves the terminal 2 to the other side in the extension direction Z and arranges the male terminal contact portion 23 in the first storage space 70*s*1. In addition, the operator arranges the electric wire connection 24 in the first storage space 70*s*1 so as to attach the terminal 2 to the insulating member 7.

Next, the operator places the front holder 5 in the extraction direction X2 with respect to the housing 6.

Next, while fixing the housing 6, the operator moves the front holder 5 in the insertion direction X1 and stores the front holder 5 inside the housing storage space 6*s*.

In this state, on the other side in the extension direction Z, the operator places the insulating member 7 to which the terminal 2 is attached with respect to the front holder 5. Next, while fixing the front holder 5, the operator moves the terminal 2 to the other side in the extension direction Z and engages the insulating member claw 74 with the front holder recess 51 (see FIG. 7), thereby arranging the insulating member 7 in the holding space 5*s*.

In this state, the front holder 5 and the housing 6 are screwed with a bolt 91 and a nut, and the housing 6 is attached to the front holder 5, whereby assembling the connector 100.

Hereinafter described is the operation of fitting the connector 100 into the counterpart connector 200. First, the operator inserts the tip of a bolt 92 into a bolt insertion hole 6*a* of the housing 6 of the connector 100 and attaches a fixing member 93 to the tip so as to attach the connector 100 to an object of interest.

Next, the operator places the counterpart connector 200 in the extraction direction X2 with respect to the connector 100. Next, while fixing the connector 100, the operator brings the counterpart connector 200 closer to the connector 100 in the insertion direction X1.

As illustrated in FIG. 9, when the male terminal contact portion 23 is inserted between the pair of female terminal contact portions 223A and 223B, the first section 71*c* comes into contact with the spring contacts 232 placed on one side in the extension direction Z, and the second section 71*d* comes into contact with the spring contacts 232 placed on the other side in the extension direction Z. At this time, when the pair of female terminal contact portions 223A and 223B is inserted into the pair of insertion openings 72*a* and 72*b* at an angle in the opposing direction Y, the first section 71*c* or the second section 71*d* elastically deforms in the opposing direction Y by a pressing force due to contacts of the spring contacts 232. That is, the first section 71*c* and the second section 71*d* come into contact with the spring contacts 232 when the male terminal contact portion 23 is inserted between the pair of female terminal contact portions 223A and 223B. On contact with the spring contacts 232, the first section 71*c* and the second section 71*d* elastically deform at least in the opposing direction Y.

Furthermore, even when the connector 100 moves in the opposing direction Y with respect to the counterpart connector 200 while the first section 71*c* or the second section 71*d* is sandwiched between the spring contacts 232 on both sides in the opposing direction Y, the first section 71*c* or the second section 71*d* elastically deforms in the opposing direction Y by the pressing force due to the contacts of the spring contacts 232.

Still further, in a case where the first section 71*c* or the second section 71*d* elastically deforms, when one of the first section 71*c* or the second section 71*d* is stationary while the other elastically deforms, the protrusion 71*c*2 and the recess 71*d*2 come into contact with each other. That is, in a case where the first section 71*c* elastically deforms but the second section 71*d* does not elastically deform or in a case where the second section 71*d* elastically deforms but the first section 71*c* does not elastically deform, when one of the first section 71*c* and the second section 71*d* elastically deforms with respect to the other in the opposing direction Y, the protrusion 71*c*2 and the recess 71*d*2 come into contact with each other. Accordingly, it is possible to prevent the first section 71*c* and the second section 71*d* from further deforming elastically.

When the operator inserts the male terminal contact portion 23 deep between the pair of female terminal contact portions 223A and 223B in the insertion direction X1, the pair of female terminal contact portions 223A and 223B comes into contact with the male terminal contact portion 23. Accordingly, the pair of female terminal contact portions 223A and 223B and the male terminal contact portion 23 are electrically connected to each other.

Finally, the operator inserts a thread of a bolt into the bolt insertion hole 250*a* of the counterpart connector 200 and attaches the counterpart connector 200 to the object of interest with a nut having a threaded hole into which the thread is screwed, thereby fitting the counterpart connector 200 into the connector 100.

The connector 100 and the connector device 300 according to this embodiment have the following configurations. The insulating member 7 includes the cover 71 formed between the pair of insertion openings 72*a* and 72*b* and opposing the male terminal contact portion 23 in the insertion direction X1. Therefore, in the connector 100 and the connector device 300 according to this embodiment, the male terminal contact portion 23 is placed deeper than the cover 71 in the insertion direction X1 when the male terminal contact portion 23 housed in the storage space 70*s* is viewed from the outside of the insulating member body 70. With such a configuration, the connector 100 and the connector device 300 according to this embodiment prevent the male terminal contact portion 23 from being exposed to the outside. Therefore, the connector 100 and the connector device 300 according to this embodiment reduce the possibility that an object comes into contact with the male terminal contact portion 23. Furthermore, the cover 71 has the both ends 71*a* and 71*b* in the extension direction Z connected to the insulating member body 70 and is divided into the first section 71*c* and the second section 71*d* by the dividing portion 71*e* formed in a part of the cover 71 in the extension direction Z. The first section 71*c* and the second section 71*d* come into contact with the spring contacts 232 when the male terminal contact portion 23 is inserted between the pair of female terminal contact portions 223A and 223B. On contact with the spring contacts 232, the first section 71*c* and the second section 71*d* elastically deform at least in the opposing direction Y. Therefore, when the pair of female terminal contact portions 223A and 223B is inserted into the pair of insertion openings 72*a* and 72*b* at an angle in the opposing direction Y, the first section 71*c* or the second section 71*d* elastically deforms in the opposing direction Y by the pressing force due to contacts of the spring contacts 232. Furthermore, even when the connector 100 moves in the opposing direction Y with respect to the counterpart connector 200 while the first section 71*c* or the second section 71*d* is sandwiched between the spring contacts 232 on both sides in the opposing direction Y, the first section 71*c* or the second section 71*d* elastically deforms in the opposing direction Y by the pressing force due to the contacts of the spring contacts 232. Accordingly, the connector 100 and the connector device 300 according to this embodiment can reduce an insertion force when the female terminal contact portions 223A and 223B are inserted into the insertion openings 72*a* and 72*b* as compared with a case where the cover 71 has no dividing portion 71*e* and has the first section 71*c* and second section 71*d* formed in an integrated manner.

The connector 100 and the connector device 300 according to this embodiment have the following configurations. When one of the first section 71*c* and the second section 71*d* elastically deforms with respect to the other in the opposing direction Y, the protrusion 71*c*2 and the recess 71*d*2 come into contact with each other. Therefore, in the connector 100 and the connector device 300 according to this embodiment, when the pressing force due to the spring contacts 232 is large and when one of the first section 71*c* and the second section 71*d* elastically deforms significantly with respect to the other in the opposing direction Y by the pressing force due to the spring contacts 232, the first section end 71*c*1 and the second section end 71*d*1 are connected via the protrusion 71*c*2 and the recess 71*d*2, which enables both ends of the cover 71 in the extension direction Z to be subjected to the pressing force due to spring contacts 232. Accordingly, in the connector 100 and the connector device 300 according to this embodiment, after one of the first section 71*c* and the second section 71*d* elastically deforms with respect to the other in the opposing direction Y, the first section end 71*c*1 and the second section end 71*d*1 are connected via the protrusion 71*c*2 and the recess 71*d*2. This makes it possible to avoid a cantilevered pressing force even when the first section 71*c* or the second section 71*d* elastically deforms significantly in the opposing direction Y, thereby preventing the generation of a large stress in either the first section 71*c* or the second section 71*d*.

The connector 100 and the connector device 300 according to this embodiment have the following configurations. The dividing portion 71*e* has a size that allows the insertion of the inspection tool 79 or a probe. Therefore, in the connector 100 and the connector device 300 according to this embodiment, when inspecting whether a desired voltage is applied to the terminal 2, the inspection tool 79 can be inserted from the dividing portion 71*e* toward the insertion direction X1 from the side of the connector 100 close to the extraction direction X2. Accordingly, in the connector 100 and the connector device 300 according to this embodiment, the male terminal contact portion 23 to be inspected is on the side where the inspection tool 79 is inserted from the dividing portion 71*e* in the insertion direction X1. Looking the tip of the inspection tool 79 from the extraction direction X2, it is easy to visually observe the contact between the tip of the inspection tool 79 and the male terminal contact portion 23. This enhances the operability at the time of inspection of the connector 100 and the connector device 300 according to this embodiment. On the other hand, in a connector including the insulating member 7 with no dividing portion 71*e*, the inspection tool 79 is to be inserted through the insertion openings 72*a* and 72*b*. Therefore, the operator is required to look through the insertion openings 72*a* and 72*b* to check whether the tip of the inspection tool 79 comes into contact with the male terminal contact portion 23, and it is difficult to visually observe the contact between the tip of the inspection tool 79 and the male terminal contact portion 23.

The connector 100 according to the aforementioned embodiment is illustrated as a shield connector. However, the connector according to the embodiment is not limited to a shield connector and may be employed as other connectors.

Furthermore, the connector 100 according to the embodiment is illustrated as one used for a connection mechanism for wire-to-wire connection. However, the connector 100 according to the embodiment is not limited to this example and may be employed as a connector used for a connection mechanism for an electric wire and an electric device connection.

In addition, the embodiment is illustrated that the cover 71 includes the protrusion 71*c*2 protruding toward the second section at the first section end 71*c*1 and the recess 71*d*2 recessed toward the second section at the second section end 71*d*1. However, the embodiment is not limited to this example. The first section end 71*cl* may be formed on a flat surface perpendicular to the extension direction Z, and the second section end 71*d*1 may be formed on a flat surface perpendicular to the extension direction Z.

Still further, the embodiment is illustrated that the protrusion 71*c*2 of the first section 71*c* has the pair of inclined surfaces extending linearly and inclined with respect to the extension direction Z and the opposing direction Y and that the recess 71*d*2 of the second section 71*d* has the pair of inclined surfaces extending linearly and inclined with respect to the extension direction Z and the opposing direction Y. However, the protrusion 71*c*2 and the recess 71*d*2 according to this embodiment are not limited in shape as long as the protrusion 71*c*2 and the recess 71*d*2 come into contact with each other when the first section 71*c* elastically deforms toward the opposing direction Y or when the second section 71*d* elastically deforms toward the opposing direction Y.

A connector and a connector device according to the embodiment have the aforementioned configuration. Accordingly, it is possible to reduce an insertion force when female terminal contact portions are inserted into insertion openings while preventing a male terminal contact part placed in a storage space from being exposed to the outside.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a male terminal including a male terminal contact portion inserted between a pair of female terminal contact portions opposing each other in an opposing direction;

an insulating member having an insulating property, including a storage space which stores at least the male terminal contact portion and allows the pair of female terminal contact portions to be inserted from the outside; and a housing configured to store the insulating member, wherein the pair of female terminal contact portions is formed with a pair of opposing surfaces opposing each other in the opposing direction across the male terminal contact portion, the pair of opposing surfaces is formed with a plurality of spring contacts elastically deformable in an extraction direction which is an opposite direction of an insertion direction in which the male terminal contact portion is inserted between the pair of female terminal contact portions, the plurality of spring contacts being formed in an extension direction perpendicular to the insertion direction, the insulating member includes an insulating member body included in the storage space, a pair of insertion openings configured to communicate with the storage space and formed in the insulating member body, corresponding to the pair of female terminal contact portions, and a cover formed between the pair of insertion openings and opposing the male terminal contact portion in the insertion direction, the cover has both ends in the extension direction connected to the insulating member body, the cover is divided into a first section and a second section by a dividing portion formed in a part of the extension direction, and the first section and the second section are configured to come into contact with the plurality of spring contacts when the male terminal contact portion is inserted between the pair of female terminal contact portions, the first section and the second section being elastically deformable at least in the opposing direction on contact with the plurality of spring contacts.

2. The connector according to claim 1, wherein the first section includes a protrusion protruding toward the second section at a first section end which is an end facing toward the second section in the extension direction, and the second section includes a recess recessed toward the second section at a second section end which is an end facing toward the first section in the extension direction, the protrusion and the recess being configured to come into contact with each other when one of the first section and the second section elastically deforms with respect to the other in the opposing direction.

3. A connector device comprising:

a counterpart connector; and a connector configured to fit into the counterpart connector, the counterpart connector including a counterpart terminal including a pair of female terminal contact portions opposing each other in an opposing direction, and a counterpart housing configured to store the counterpart terminal, and the connector including a male terminal including a male terminal contact portion inserted between the pair of female terminal contact portions, an insulating member having an insulating property, including a storage space which stores at least the male terminal contact portion and allows the pair of female terminal contact portions to be inserted from the outside, and a housing configured to store the insulating member, wherein the pair of female terminal contact portions is formed with a pair of opposing surfaces opposing each other in the opposing direction across the male terminal contact portion, the pair of opposing surfaces is formed with a plurality of spring contacts elastically deformable in an extraction direction which is the opposite direction of an insertion direction in which the male terminal contact portion is inserted between the pair of female terminal contact portions, the plurality of spring contacts being formed in an extension direction perpendicular to the insertion direction, the insulating member includes an insulating member body included in the storage space, a pair of insertion openings configured to communicate with the storage space and formed in the insulating member body, corresponding to the pair of female terminal contact portions, and a cover formed between the pair of insertion openings and opposing the male terminal contact portion in the insertion direction, the cover has both ends in the extension direction connected to the insulating member body, the cover is divided into a first section and a second section by a dividing portion formed in a part of the extension direction, and the first section and the second section are configured to come into contact with the plurality of spring contacts when the male terminal contact portion is inserted between the pair of female terminal contact portions, the first section and the second section being elastically deformable at least in the opposing direction on contact with the plurality of spring contacts.

* * * * *